US011986069B2

(12) United States Patent
Jaiswal

(10) Patent No.: US 11,986,069 B2
(45) Date of Patent: May 21, 2024

(54) PIVOT CHAIN END FOR JEWELRY

(71) Applicant: Sanjay Jaiswal, Mumbai (IN)

(72) Inventor: Sanjay Jaiswal, Mumbai (IN)

( * ) Notice: Subject to any disclaimer, the term of this patent is extended or adjusted under 35 U.S.C. 154(b) by 0 days.

(21) Appl. No.: 17/309,393

(22) PCT Filed: Oct. 7, 2020

(86) PCT No.: PCT/IB2020/059406
§ 371 (c)(1),
(2) Date: May 25, 2021

(87) PCT Pub. No.: WO2021/260424
PCT Pub. Date: Dec. 30, 2021

(65) Prior Publication Data

US 2023/0108215 A1 Apr. 6, 2023

(30) Foreign Application Priority Data

Jun. 22, 2020 (IN) ..... 202021026237

(51) Int. Cl.
*A44C 5/20* (2006.01)
*A44C 15/00* (2006.01)

(52) U.S. Cl.
CPC ..... *A44C 5/2057* (2013.01); *A44C 15/005* (2013.01)

(58) Field of Classification Search
CPC ..... Y10T 403/32975; Y10T 24/47; Y10T 24/4745; Y10T 24/4764; F16G 15/08; A44C 5/2076; A44C 5/208; A44C 5/185; A44C 5/2057; A44C 15/005
USPC ..... 63/3.1, 4, 10; 59/95
See application file for complete search history.

(56) References Cited

U.S. PATENT DOCUMENTS

| | | | | |
|---|---|---|---|---|
| 2,466,243 | A * | 4/1949 | Johnson | A01K 91/03 59/95 |
| 2,758,440 | A * | 8/1956 | Magid | F41C 23/02 411/339 |
| 4,309,121 | A * | 1/1982 | Salame | F16C 21/00 403/164 |
| 4,482,264 | A * | 11/1984 | Kodera | F16G 15/08 59/95 |
| 2009/0101786 | A1* | 4/2009 | Faull | A47C 3/18 297/344.21 |

FOREIGN PATENT DOCUMENTS

| | | | | |
|---|---|---|---|---|
| CH | 702510 | A2 * | 7/2011 | A44C 5/208 |

* cited by examiner

*Primary Examiner* — Jack W Lavinder

(57) ABSTRACT

A pivot chain end for a jewelry is provided in the present embodiment. The pivot chain end has a 360 degree linking mechanism for chains having jewelry items which helps in arresting the improper fall issue of the necklace when worn by a wearer. The pivot chain end includes an eyelet which is circular in shape linked with a back chain having an abutted cylindrical portion with a through hole and a metal disc having three flat flanks and one curved ridged side, wherein the metal disc allows the screw to pass through within the disc and connect the eyelet, through a partially threaded body on the screw, thereby securing the metal disc with the eyelet and enabling the eyelet to freely rotate 360 degree axially as per movement of the back chain.

6 Claims, 4 Drawing Sheets

PIVOT CHAIN END FOR JEWELRY

BACKGROUND

Technical Field

The embodiments herein generally relate to a pivot chain end for a jewelry and more particularly, to a 360 degree linking mechanism for chains with jewelry items which helps in arresting the improper fall issue of the necklace when worn by a wearer.

Description of the Related Art

Generally, necklace fall issue is a perennial problem being faced in the industry since time immemorial and more specifically in the Indian market as the neckwear are large pieces covering a large portion of the neck. Also while the fall of a neckwear is designed on a mannequin and the fall checked on a few women, the fact remains that the profile of each woman is different in terms of height of shoulder, collar bone and curves of the neck.

The root cause of the problem lies in the point where the chain was joined to the neckwear, where the point is rigid. The chains are either soldered directly onto the neckwear or linked with an "0" shaped eyelet. However, when the wearer turns the faces, the position of the collar bones and curves of the neck changes and this affects the fall of the necklace.

The biggest challenge is therefore to ask How to Keep Necklace Part Still irrelevant to the complexity and variable nature of Human body at one side and the different design, linking, weight, gravity of the necklace itself at other side. Another challenge is which chain is to be used to keep the necklace flexible. And then how to rotate the chain 360 degree to prevent any fall issue. The strength of the joint in terms of ball slipping out is also to be considered.

Accordingly, there remains a need for a mechanism or technique to provide a 360 degree linking mechanism for chains with jewelry items which helps in arresting the improper fall issue of the necklace when worn by a wearer. The technique should also provide to make the rotation easy to move even after long use. This should also prevent dust from going inside the mechanism during wearing of the necklace.

SUMMARY

The embodiment herein provides a pivot chain end for a jewelry. The pivot chain end includes an eyelet circular in shape, which is linked with a back chain includes an abutted cylindrical portion having a through hole, wherein the hole is threaded to accommodate a bottom screw with a cylindrical head, whereby the screw is threaded in partial portion of body of the screw in order to secure any article within the body of the screw; and a metal disc preferably made of gold or gold plating characterized in that the disc having three flat flanks and one curved ridged side, wherein the metal disc allows the screw to pass through within the disc such that the cylindrical head of the screw rests within larger hole of the metal disc on one side, the body of the screw passing to other side from a smaller hole and connecting the eyelet, wherein the partially threaded body facilitates securing the metal disc with the eyelet and enabling the eyelet to freely rotate 360 degree axially as per movement of the back chain.

In an embodiment, surface on one side of the metal disc is welded with chain containing a jewelry. The metal disc may be made of any metal used in jewelry or otherwise. The eyelet is of any shape rectangle, square, triangle or like.

In an embodiment, the eyelet and the metal disc has a gap in between them to allow the eyelet to freely rotate 360 degree along the axis as per movement of the back chain. The metal disc may be chemically treated to provide a smooth surface of the metal disc which allows low friction rotation of the eyelet and the screw.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which.

DETAILED DESCRIPTION OF PREFERRED EMBODIMENTS

As mentioned, there remains a need for a mechanism or technique to provide a 360 degree linking mechanism for chains with jewelry items which helps in arresting the improper fall issue of the necklace when worn by a wearer. The technique should also provide to make the rotation easy to move even after long use. This should also prevent dust from going inside the mechanism during wearing of the necklace.

The present embodiments herein provides a 360 degree linking mechanism for chains with jewelry items which helps in arresting the improper fall issue of the necklace when worn by the wearer. This linking mechanism will Keep necklace part still as only the chain movement will be there, when the wearer face is turned. A small golden ball or cylindrical head is tied/linked between the chain and stud part which allows to rotate 360 degree comfortably. After lot of pull test we have finally reached to conclusion that the strength is enough to lift up to 1.5 Kg. Referring now to FIG. 1 through 4 to describe the various embodiments of the present invention.

Figure 1:
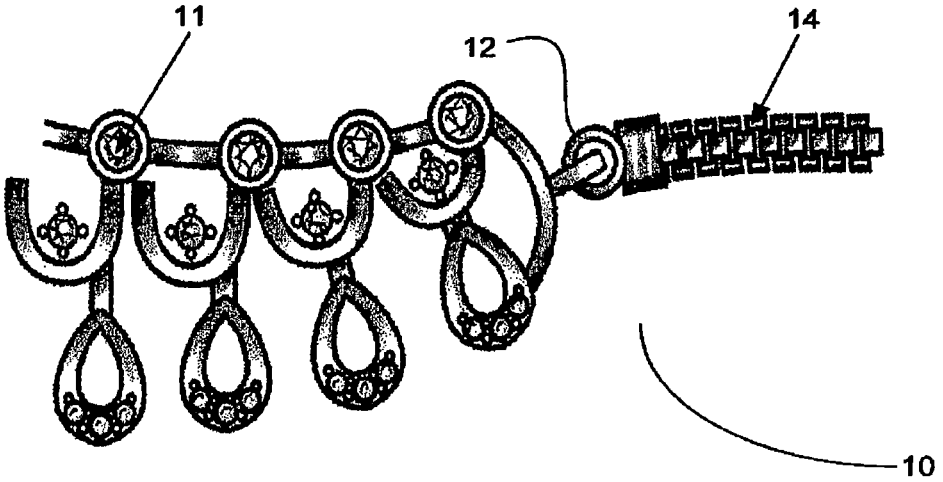
PRIOR ART FIG. 1
FIG. 1 illustrates a typical arrangement of a necklace having a rigid eyelet which links back chain and jewelry items according to an embodiment mentioned herein.

FIG. 1 illustrates a typical arrangement of a necklace 10 having a rigid O shaped eyelet which links back chain and jewelry items according to an embodiment mentioned herein. The necklace 10 consists of a front casting 11 which contains the precious stones and motifs and a gold chain called back chain 14 which needs to be fastened at the back using a clasp or a hook. The back chain and the front casting of the necklace are traditionally soldered together directly or by using an eyelet 12. Since this joint is stiff, whenever there is a movement of the casting, the eyelet pushes the chain, which then twists resulting in uneven fall and sparkle of diamonds getting affected.

Figure 2:
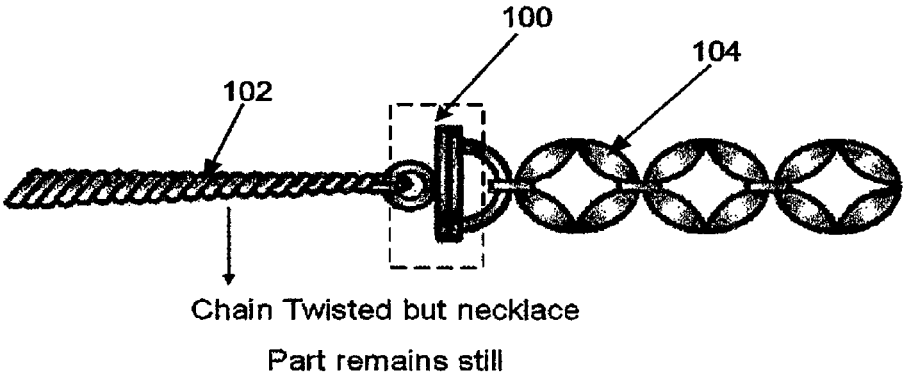
FIG. 2 illustrates a 360 degree pivot end for jewelry which keeps jewelry items still even when back chain is rotated according to an embodiment mentioned herein.

Now, the solution of preventing an uneven fall is depicted in FIG. 2 illustrating a 360 degree pivot end 100 for jewelry which keeps jewelry items 104 still even when back chain 102 is rotated according to an embodiment mentioned herein. Here, the circular eyelet will link with the back chain is capable of rotating freely 360 degree along an axis thus resulting in neckwear to adopt as per the collar bone and gravity balance of necklace fall this would prevent the uneven fall issue faced by the wearer of the necklace.

Figure 3:
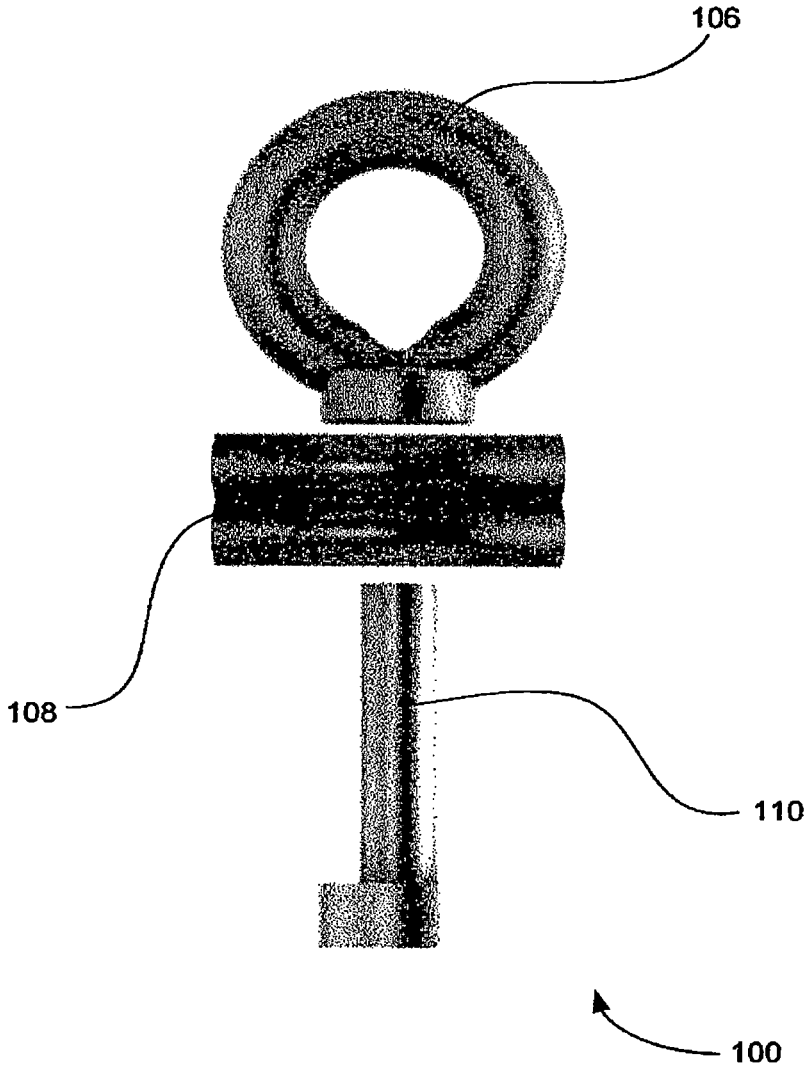
FIG. 3 illustrates an exploded view of the 360 degree pivot end according to an embodiment mentioned herein.

FIG. 3 illustrates an exploded view of the 360 degree pivot end 100 according to an embodiment mentioned herein. The pivot chain end 100 includes a circular eyelet 106, a metal disc 108 and a bottom screw. In an embodiment, The metal disc 108 may preferably be made from gold or plated with gold. All the components may be made from any other metals like gold, silver, platinum, etc. but not limited to the embodiments mentioned herein.

In an embodiment, the metal disc may be specially treated with chemicals to provide a smooth surface of the metal disc which will allow low friction while rotation of the O ring and the screw. Here the eyelet 106 may be circular in shape. In an example embodiment, the eyelet may be of any other shape like rectangle, square, triangle, etc. but not limited to the embodiments mentioned herein. In an embodiment, the eyelet 106 is linked with a back chain 102.

Figure 4:
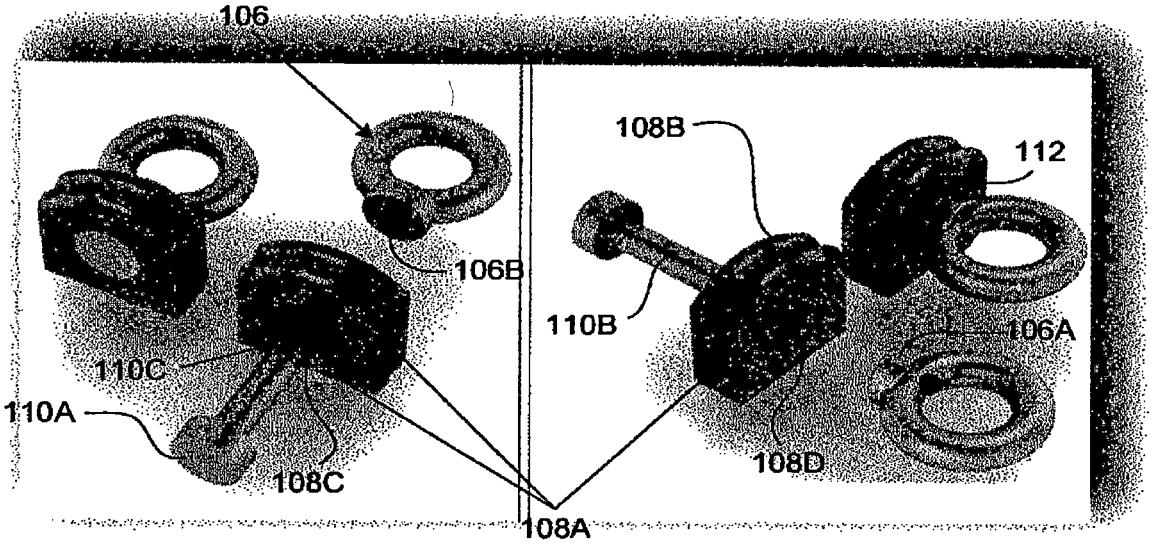
FIG. 4 illustrates a different linkage components forming the 360 degree pivot end according to one example embodiment mentioned herein.

FIG. 4 illustrates a different linkage components forming the 360 degree pivot end 100 according to one example embodiment mentioned herein. Here, an abutted cylindrical portion 106A is provided in the eyelet which is having a through hole 106B. In an embodiment, the hole 106B may be threaded to accommodate a bottom screw 110 having a cylindrical head 110A.

In an embodiment, the screw may be partially threaded 110C on body 110B of the screw in order to secure any article within the body of the screw. The metal disc 108 includes a three flat flanks 108A and one curved ridged side 108B. In an embodiment, the metal disc allows the screw 110 to pass through within the disc such that the cylindrical head of the screw rests within larger hole 108C of the metal disc on one side, the body 110B of the screw passing to other side from a smaller hole 108D connecting the circular eyelet.

In an embodiment, the partially threaded body 110C facilitates securing the metal disc with the eyelet and enabling the eyelet to freely rotate 360 degree axially as per movement of the back chain 102.

In one embodiment, one side of the metal disc may be welded with the chain 102 containing the jewelry 104. Here the metal disc may be made of any metal used in jewelry or otherwise. The eyelet and the metal disc has a gap 112 in between them to allow the eyelet to freely rotate 360 degree along the axis as per movement of the back chain with minimum friction.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope.

I claim:

1. A pivot chain end (100) for jewelry comprising:

an eyelet (106) circular in shape, which is linked with a back chain (102) includes an abutted cylindrical portion (106A) having a through hole (106B), wherein the through hole (106B) is threaded to accommodate a screw (110) having a cylindrical head (110A), whereby the screw is partially threaded (110C) on a body (110B) of the screw in order to secure the eyelet on the body of the screw; and a metal disc (108) preferably made of gold or gold plating characterized in that the metal disc having three flat flanks (108A) and one curved ridged side (108B), wherein the metal disc allows the screw to pass through the metal disc such that the cylindrical head of the screw rests within a larger hole (108C) of the metal disc on one side, the body (110B) of the screw passes through to other side from a smaller hole (108D) connecting the eyelet, wherein the partial thread on the body (110C) facilitates securing the metal disc with the eyelet and enabling the eyelet to freely rotate 360 degree axially as per movement of the back chain (102).

2. The pivot chain end for jewelry as claimed in claim 1, wherein one side of the metal disc is welded with a chain containing a jewelry (104).

3. The pivot chain end for jewelry as claimed in claim 1, wherein the metal disc is made of any metal used in jewelry.

4. The pivot chain end for jewelry as claimed in claim 1, wherein the eyelet is of any shape rectangle, square, triangle or like.

5. The pivot chain end for jewelry as claimed in claim 1, wherein the eyelet and the metal disc has a gap (112) in between them to allow the eyelet to freely rotate 360 degree along an axis as per movement of the back chain with minimum friction.

6. The pivot chain end for jewelry as claimed in claim 1, wherein the metal disc is chemically treated to provide a smooth surface of the metal disc which allows low friction while rotation of the eyelet and the screw.

* * * * *